United States Patent [19]

Yabu et al.

[11] Patent Number: 4,613,840

[45] Date of Patent: Sep. 23, 1986

[54] RELAY FOR HIGH-FREQUENCY CIRCUITS

[75] Inventors: Hisao Yabu; Kenji Tsuji; Akinori Hirabayashi, all of Osaka, Japan

[73] Assignees: Matsushita Electric Works, Ltd., Osaka, Japan; Hans Sauer, Deisenhofen, Fed. Rep. of Germany

[21] Appl. No.: 681,600

[22] Filed: Dec. 14, 1984

[51] Int. Cl.[4] ..... H01H 67/02

[52] U.S. Cl. ..... 335/128; 335/129; 335/132

[58] Field of Search ..... 335/128, 129, 276, 132, 335/133, 274

[56] References Cited

U.S. PATENT DOCUMENTS 3,993,971 11/1976 Ono et al. .
4,260,971 4/1981 Baumruck ..... 335/128
4,296,393 10/1981 Sauer et al. ..... 335/128

FOREIGN PATENT DOCUMENTS 34811 9/1981 European Pat. Off. .
124109 11/1984 European Pat. Off. .

*Primary Examiner*—George Harris
*Attorney, Agent, or Firm*—Schwartz, Jeffery, Schwaab, Mack, Blumenthal & Evans

[57] ABSTRACT

An electromagnetic relay for use in a high-frequency circuit includes an armature 3 mounted on a central shaft 16 for pivotal movement between two switching positions. A total of four actuator cards 5 are disposed on two opposite sides of the armature 3, each card carrying a contact spring 8. Each contact spring serves to bridge a pair of fixed contacts 6, 7. The contact springs and fixed contacts are located in shield casings 9 disposed on both sides of the armature 3. Return springs 19 urge the cards 5 into abutment with the respective sides of the armature 3. Sufficient electrical separation as required for high-frequency applications is achieved between the two contact systems due to the intermediate disposition of the armature 3. The provision of an individual actuator card 5 for each contact spring 8 permits independent adjustment of each contact.

12 Claims, 7 Drawing Figures

FIG.1
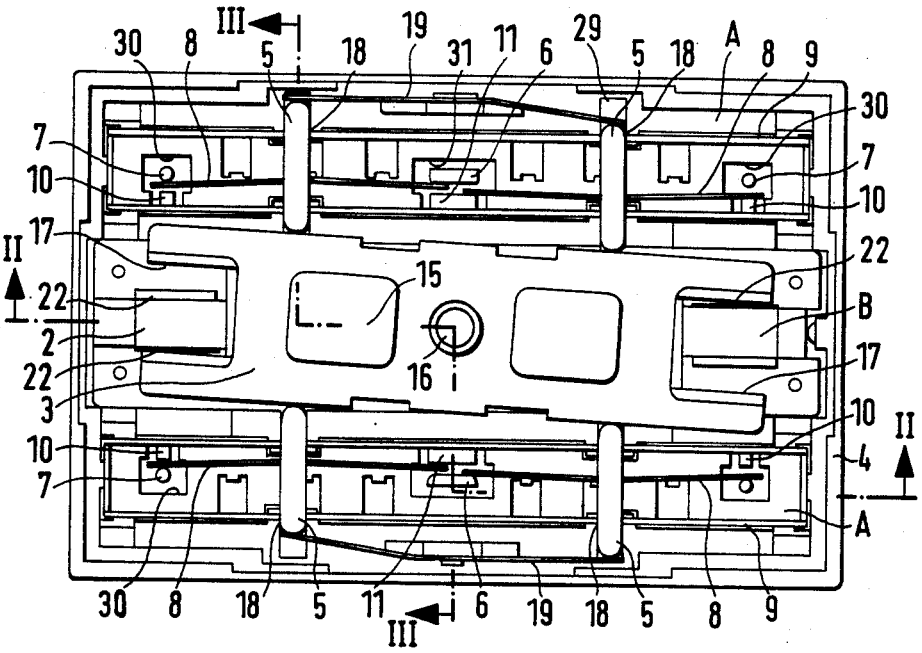
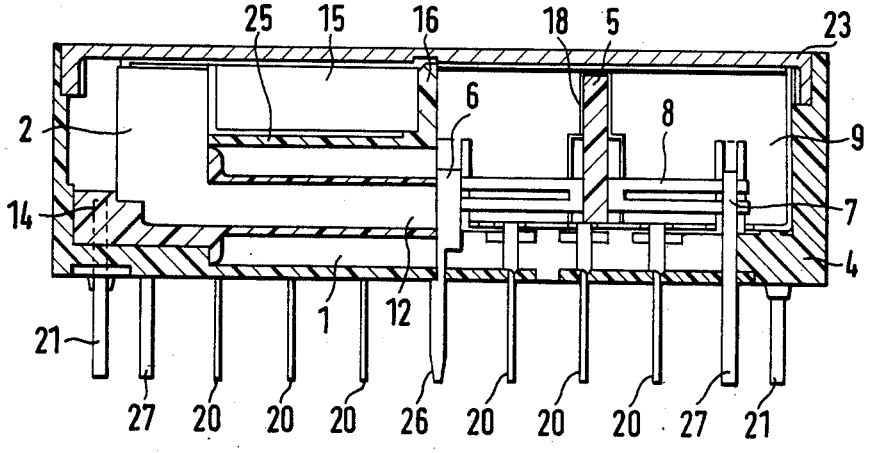
FIG.2

RELAY FOR HIGH-FREQUENCY CIRCUITS

BACKGROUND OF THE INVENTION

This invention relates to an electromagnetic relay for use in a high-frequency circuit.

A single-pole relay for switching high-frequency currents has been proposed in which a contact system contained in an elongate shield casing is disposed at one side of the relay coil and includes two contact springs mounted in an actuator which is moved between two switching positions in a direction perpendicular of the relay coil by means of an L-shaped armature due to energization of the coil. The two contact springs extend parallel to the coil axis and cooperate with a total of three fixed contacts inserted in the high-frequency circuit to be switched by the relay, so as to form a single-pole switch-over contact system.

If the relay of the above type were designed so that the two opposite poles of a high-frequency circuit could be switched-over simultaneously by the same actuator movement, two contact systems would be required which would have to be separated from each other by a sufficient spacing to achieve the necessary electrical separation between the two opposite polarities. The overall size of such a relay would become considerable.

Another problem with the relay described above resides in the fact that both contact springs are fixed to the same actuator. Therefore, if the closing and opening function of one contact spring is to be adjusted by applying pressure to the spring to cause a slight deformation thereof, thus a variation in the contact pressure, such manipulation will also influence the characteristic of the other contact spring, so that an adjustment of the whole structure is difficult.

It is an object of the present invention to provide a relay for high-frequency circuits capable of switching two different polarities thereof, in which sufficient electrical separation between the two polarities is achieved at comparatively small overall relay dimensions. It is another object of the invention to provide a relay of this type in which each contact may be independently adjusted.

SUMMARY OF THE INVENTION

In view of the above objects, the electromagnetic relay of the present invention comprises a coil; an armature block mounted for pivotal movement between two switching positions by energization of the coil; a pair of contact systems disposed on opposite sides of the armature block, each contact system being surrounded by electrically conductive shield means and including a first fixed contact disposed in the high-frequency circuit, a second fixed contact connected to the shield means, and a movable contact; and actuator means linking the movable contacts to the armature block for causing engagement between each movable contact and the associated first and second fixed contact, respectively, in either switching position of the armature block.

Due to the disposition of the armature block between the two contact systems, a spacing between the contact systems as required for high-frequency installations is achieved even though all three of these components are arranged closely together to achieve minimum overall relay dimensions.

In a preferred embodiment of the invention, each movable contact is formed by a contact spring mounted in a separate actuating member which is independently coupled to the armature block. Preferably, each such actuating member is formed by a card mounted for slidable movement generally perpendicularly to the sides of the armature block, with one end of the card abutting the armature block and the opposite end being biased by a spring towards the armature block. With such a structure, each individual contact spring may be independently adjusted in its switching behaviour by deformation without influencing the characteristics of the other contact springs.

BRIEF DESCRIPTION OF THE DRAWINGS

FIG. 1 is a top view (cover removed) of a double-pole relay for use in a high-frequency circuit in accordance with an embodiment of the invention;

FIG. 2 is a section taken along the line II—II of FIG. 1;

DETAILED DESCRIPTION OF PREFERRED EMBODIMENTS

As shown in FIG. 1, a magnet system B is disposed in the center of the relay, and two contact systems A are disposed on both sides of the magnet system B.

Figure 3:
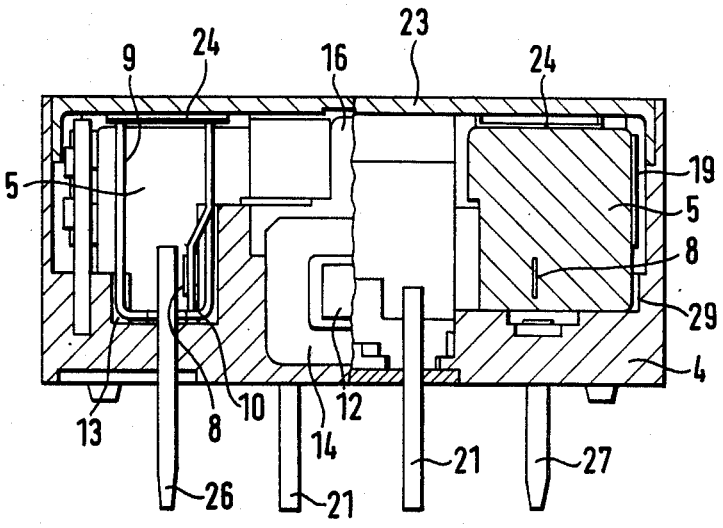
FIG. 3 is a section taken along the line III—III in FIG. 1.

Referring to FIGS. 1 to 3, the magnet system B includes a coil 1 wound about a bobbin 14 located in a base member 4, with the axis of the coil 1 extending parallel to a center line of the base member 4. The ends of the coil 1 are connected to coil terminals 21 which extend downwardly through the bobbin 14 and the base member 4.

A generally U-shaped yoke 12 extends through a central bore of the bobbin 14. Both ends of the yoke 12, which form magnetic pole pieces 2, extend from the ends of the bobbin 14 upwardly and perpendicularly with respect to the coil axis. Non-magnetic separating plates 22 are provided on the two opposite lateral faces of each pole piece 2.

A generally H-shaped armature 3 is pivotally mounted about an upwardly extending shaft 16 integrally formed on a bearing plate 25 mounted on the bobbin 14. The armature 3 contains two parallel pole plates 17 and a permanent magnet 15 disposed therebetween in such a manner that the pole plates 17 abut opposite poles of the magnet 15. The ends of the pole plates 17 cooperate with the pole pieces 2 of the yoke 12. In the embodiment shown in FIG. 1, the separating plates 22 disposed on opposite faces of each pole piece 2 have different thicknesses to achieve a monostable relay function, in which the position shown in FIG. 1 is the inoperative switching position. When the coil 1 is energized, the armature 3 will rotate counter-clockwise about the shaft 16 to the other switching position in which the respective other ends of the pole plates 17 abut those faces of the pole pieces 2 where the thicker separating plates 22 are provided. When the coil 1 is deenergized, the armature 3 will return to the rest position shown in FIG. 1.

A polarized electromagnetic relay having a magnet system of the general type so far described is known from U.S. Pat. No. 3,993,971.

As further shown in FIGS. 1 to 3, each contact system A includes a central fixed contact 6, a pair of outer fixed contacts 7 disposed to form, with the central contact 6, a straight line parallel to the coil axis, and a pair of movable contact springs 8, also generally extending parallel to the coil axis. The fixed contacts 6, 7 are connected to respective contact terminals 26, 27 which extend downwardly through the base member 4, as shown in FIGS. 2 and 3.

Each bifurcated contact spring 8 is embedded in an actuator card 5 so as to project from both sides of the card at substantially equal lengths. Each card 5 slidably engages a guiding groove 29 provided in the base member 4 as shown in FIGS. 1 and 3. The inner end of each card 5 abuts against a side surface of the armature 3, and a return spring 19 engages the outer end of the card 5 to bias the card against the armature 3. As shown in FIG. 1, a common return spring 19 is provided for both cards 5 disposed on the same side of the armature 3.

The outer end of each contact spring 8 is disposed between an outer fixed contact 7 and an outer ground contact 10. The inner end of each contact spring 8 is disposed between the central fixed contact 6 and a central ground contact 11. The central fixed contact 6 and the central ground contact 11 are of increased width for cooperation with both contact springs 8 of the same contact system A. Alternatively, separate middle contacts may be provided for cooperation with the two contact springs to provide a four-contact system.

In the rest position of the relay shown in FIG. 1, the upper left contact spring 8 and the lower right contact spring 8 each bridge the corresponding outer fixed contact 7 with the central fixed contact 6, while the upper right contact spring 8 and the lower left contact spring 8 each bridge two ground contacts 10, 11. When the coil 1 is energized and the armature 3 is rotated into its other switching position, the upper left and lower right contact springs will bridge ground contacts, whereas the upper right and lower left contact springs will each interconnect an outer contact 7 with the respective central contact 6. When the fixed contacts 6, 7 of the two contact systems A are inserted in the two poles of a high-frequency circuit, a double-pole switch-over relay action is thus achieved.

Figure 4:
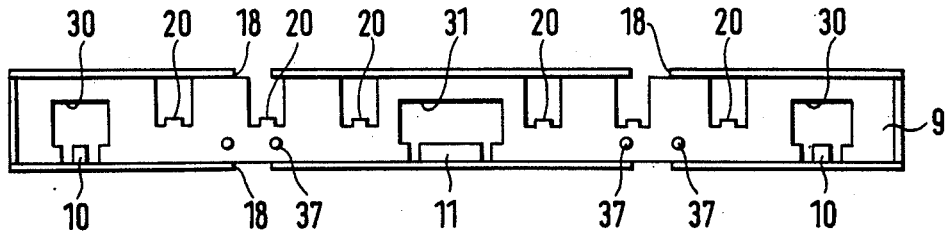
FIG. 4 is a top view of a shield casing which forms part of the relay of FIG. 1.
Figure 5:
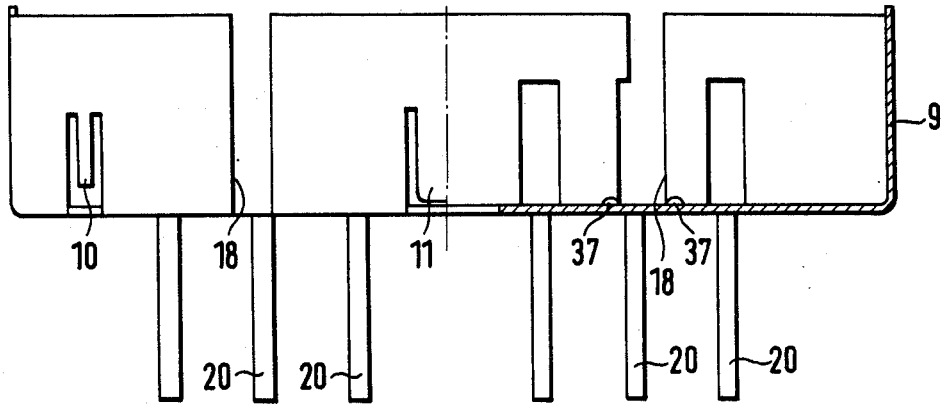
FIG. 5 is a side view, partly shown in section, of the shield casing of FIG. 4.

Each contact system A is surrounded by an open-top elongate shield casing 9 which is shown as such in FIGS. 4 and 5. A total of six ground terminals 20 are formed by punching and bending strips from the side and bottom walls of the casing 9. These ground terminals also extend downwardly through the base member 4 as shown in FIG. 2. Further strips of material are cut and bent from the side wall of the casing 9, which form the ground contacts 10 and 11. In areas of the bottom wall of the shield casing 9 adjacent to the ground contacts 10, 11, appertures 30 and 31 are provided through which the fixed contacts 7 and 6 project into the interior of the shield casing 9, as shown in FIG. 1. The side walls of the casing 9 are further provided with windows 18 through which the cards 5 extend. A pair of projections 37 may be provided on the bottom wall of the casing 9 in alignment with the two lateral edges of each pair of opposing windows 18 to guide the respective card 5.

The shield casings 9 are inserted in recesses 13 of the base member 4 as shown in FIG. 3. The bottom surface of these recesses 13 is situated below the bottom surface of the grooves 29 which serve to guide the cards 5. The shield casings 9 are held in place in their recesses 13 by means of their ground terminals 20 which penetrate through the base member 4.

Figure 6:
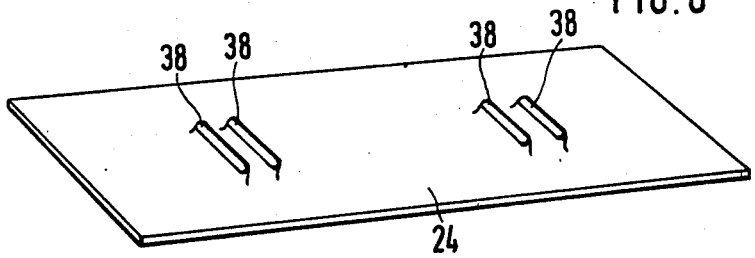
FIG. 6 is a perspective view of a shield plate for closing the shield casing of FIGS. 4 and 5.

A cover 23 closes the upper side of the base member 4 and carries two shield plates 24 which serve to close the open tops of the shield casings 9. As shown in FIG. 6, the underside of each shield plate 24 is provided with two pairs of parallel ribs 38 which further serve to guide the respective cards 5.

While the shield casings 9 and shield plates 24 are of highly conductive material, just as are the fixed contacts 6, 7 with their contact terminals 26, 27 and the contact springs 8, the base member 4, the cover 23 and the cards 5 are of insulating, preferably synthetic material, just as all other components of the relay which have neither an electrical nor a magnetic function. When the armature 3 is in a neutral center position in which its longitudinal axis extends parallel to the coil axis, the whole relay structure is symmetrical with respect to that axis and also with respect to an axis which is perpendicular thereto and extends vertically in FIG. 1.

Figure 7:
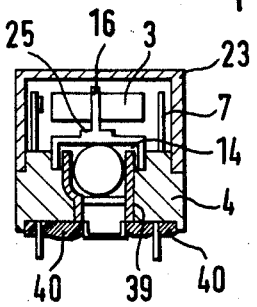
FIG. 7 is a sectional view on a reduced scale of another embodiment of the invention.

FIG. 7 shows a schematic cross-sectional view of an embodiment in which the base member 4 is provided with holes 39 to permit a sealant, which is used to seal the terminals 20, 21, 26 and 27 to the base member 4, to reach the bearing plate 25 for the armature 3 and to serve as an adhesive for fixing the bearing plate 25 to the base member 4.

We claim:

1. An electromagnetic relay for use in a high-frequency circuit, comprising a coil, an armature block mounted for pivotal movement between two switching positions by energization of said coil, a pair of contact systems disposed on opposite sides of said armature block, each contact system being surrounded by electrically conductive shield means and including a first fixed contact disposed in said high-frequency circuit, a second fixed contact connected to said shield means, and a movable contact, and actuator means linking said movable contacts to said armature block for causing engagement between each movable contact and the associated first and second fixed contact, respectively, in either switching position of said armature block.

2. The relay of claim 1, wherein said armature block is pivotal about a central axis thereof, and wherein each contact system includes two movable contacts disposed symmetrically with respect to said central axis.

3. The relay of claim 2, wherein each movable contact cooperates with a pair of first fixed contacts disposed in said high-frequency circuit and a pair of second fixed contacts connected to said shield means.

4. The relay of claim 2, wherein each contact system includes centrally disposed first and second fixed contacts of sufficient contact area to cooperate with both movable contacts of the same contact system.

5. The relay of claim 1, wherein each movable contact is formed by a contact spring mounted in a separate actuating member independently coupled to said armature block.

6. The relay of claim 5, wherein each actuating member is formed by a card member movable generally perpendicularly to the respective side of said armature block, and has its one end abutting said armature block and its opposite end biased by a spring towards said armature block.

7. The relay of claim 6, including a base member having grooves for slidably guiding said card members.

8. The relay of claim 1, wherein each said shield means includes a substantially box-shaped casing having a plurality of ground terminals, said second fixed contacts being formed integrally with said casing.

9. The relay of claim 8, including a base member and a cover cooperating with said base member to enclose said coil, armature block and contact systems, said shield casings being mounted on said base member, and said cover carrying shield plates for closing said shield casings.

10. The relay of claim 1, including a yoke member having a main portion extending through a central bore of said coil and end portions projecting from said coil substantially transversely of said main portion, wherein said armature block includes a permanent magnet and a pair of elongate pole pieces abutting oppositely polarized faces of said magnet, each yoke end portion being disposed between a pair of ends of said pole pieces.

11. The relay of claim 1, including a base member, terminals of said fixed contacts extending through said base member, and said armature block being pivotally supported on a bearing member fixed to said base member.

12. The relay of claim 11, wherein said base member has through-holes for receiving a sealant which serves to seal said terminals and said bearing member to said base member.

* * * * *